US005939959A

United States Patent [19]

Ono

[11] Patent Number: 5,939,959

[45] Date of Patent: Aug. 17, 1999

[54] DIELECTRIC FILTER WITH ELEVATED INNER REGIONS ADJACENT RESONATOR OPENINGS

[75] Inventor: Shoji Ono, Nagoya, Japan

[73] Assignee: NGK Spark Plug Co., Ltd., Nagoya, Japan

[21] Appl. No.: 08/953,237

[22] Filed: Oct. 17, 1997

[30] Foreign Application Priority Data

Oct. 24, 1996 [JP] Japan ..... 8-301006

[51] Int. Cl.[6] ..... H01P 1/205

[52] U.S. Cl. ..... 333/206; 333/207

[58] Field of Search ..... 333/202, 206, 333/207, 222, 223

[56] References Cited

U.S. PATENT DOCUMENTS

| | | | |
|---|---|---|---|
| 4,673,902 | 6/1987 | Takeda et al. | 333/202 |
| 4,733,208 | 3/1988 | Ishikawa et al. . | |
| 4,761,624 | 8/1988 | Igarashi et al. | 333/206 |
| 4,965,537 | 10/1990 | Kommrusch | 333/207 X |
| 4,987,393 | 1/1991 | Yorita et al. | 333/202 |
| 5,150,089 | 9/1992 | Komazaki et al. | 333/207 X |
| 5,721,520 | 2/1998 | McVeety et al. | 333/206 X |

FOREIGN PATENT DOCUMENTS

| | | | |
|---|---|---|---|
| 60-052102 | 3/1985 | Japan . | |
| 60-254802 | 12/1985 | Japan | 333/202 |
| 5-56681 | 5/1988 | Japan . | |
| 05014011 | 1/1993 | Japan . | |
| 5-175708 | 7/1993 | Japan | 333/202 |
| 6-97721 | 11/1994 | Japan . | |
| 09213806 | 8/1996 | Japan . | |
| WO 94 10719 | 5/1994 | WIPO . | |

*Primary Examiner*—Seungsook Ham
*Attorney, Agent, or Firm*—Larson & Taylor

[57] ABSTRACT

A dielectric filter in which an open-circuiting end surface of a dielectric ceramic block is provided with a conductor pattern for each of the inner resonators and an additional conductor for each of the outermost resonators, the conductor patterns are intended to capacitively coupling the resonators with each other, and the additional conductors are intended to increase the effective resonant length of the outermost resonators, thereby the resonant frequencies of the resonators can be made substantially agree with each other.

6 Claims, 4 Drawing Sheets

DIELECTRIC FILTER WITH ELEVATED INNER REGIONS ADJACENT RESONATOR OPENINGS

BACKGROUND OF THE INVENTION

1. Field of the Invention

The present invention relates to a dielectric filter comprising a plurality of dielectric resonators juxtaposed in a dielectric ceramic block.

2. Prior Art

There are known dielectric filters of the type comprising a rectangularly parallelepipedic dielectric ceramic block, three or more than three resonators each of which includes a through hole extending longitudinally in the dielectric ceramic block and an inner conductor provided on a peripheral wall of the through hole, and an outer conductor covering the substantial portion of the outer peripheral surface of the dielectric ceramic block, except one end surface of the dielectric ceramic block which forms an open-circuiting end surface on which one opening ends of the through holes are arranged, the other opening ends thereof being arranged on a short-circuiting surface opposite to the open-circuiting end surface of the dielectric ceramic block.

FIGS. 1 and 2 of the accompanying drawings show a conventional dielectric filter of the above identified type with three resonators, a central resonator A and two outer resonators B in a dielectric ceramic block, wherein an open-circuiting end surface of the the dielectric ceramic block is provided with a conductor pattern C which is extended from the edge of the opening on the open-circuiting end surface of the dielectric ceramic block toward the edges of the openings of the adjacently located outer resonators B. One end of the conductor pattern C is connected to the inner conductor of the central resonator A and the other end or free end of the the conductor pattern C is separated from the edges of the openings of the outer resonators B by respective insulating gaps G in order to realize a capacitive interstage coupling for coupling the resonators with each other.

While the resonators A and B are normally made to have a length equal to $\lambda/4$ or a quarter of a specified resonant frequency, the conductor pattern C formed as an extension of the central resonator A increases the effective resonant length of the resonator A to lower its resonant frequency and make it disagree with those of the outer resonators B. Consequently, such a dielectric filter does not provide a satisfactory filtering effect.

This problem may be overcome by the provision of a recess D in a central area of the bottom of the dielectric ceramic block as shown in FIGS. 1 and 2, which is the short-circuiting end of the dielectric ceramic block, to make the resonant length of the central resonator A shorter than that of the outer resonators B and shift the resonant frequency of the resonator A upward in advance in order to compensate the lowered resonant frequency of the central resonator A and make the resonant frequencies of all the resonators consequently agree with each other.

It should be noted that such a conventional dielectric filter is provided with a conductive film E on the short-circuiting end surface of the dielectric ceramic block, and the conductive film E is connected to the edges of the openings of the resonators on that side. The conductive film E is typically prepared by screen printing which is adapted to mass production. However, with the configuration of the dielectric filter of FIGS. 1 and 2 having a recess D formed in a central area of the short-circuiting end surface, the screen printing technique cannot feasibly be used and the conductive film E has to be formed by applying a conductive material to that side by means of a brush at the cost of manufacturing efficiency. In short, such a configuration is not adapted to mass production.

It is, therefore, the object of the present invention to provide a dielectric filter that can provide a necessary coupling capacitance without requiring the formation of a recess on a short-circuiting end surface of a dielectric ceramic block to make the resonant frequencies of the resonators agree with each other.

SUMMARY OF THE INVENTION

According to one aspect of the invention, there is provided a dielectric filter comprising:

a dielectric ceramic block;

three resonators each of which includes a through hole in the dielectric ceramic block and an inner conductor provided on a peripheral wall of the through hole;

an outer conductor covering a specific area of the outer peripheral surface of the dielectric ceramic block except one end surface of the dielectric ceramic block which forms an open-circuiting end surface on which one openings of the through holes are positioned, the other openings being positioned at the other end surface of the dielectric ceramic block which is a short-circuiting end surface;

a conductor pattern provided on the open-circuiting end surface for each inner resonator, each conductor pattern having one end connected to the inner conductor of the inner resonator and other end or free end extended toward an edge of the opening of the adjacently located resonator;

an insulating gap provided between the free end of each conductor pattern and the edge of the opening of the corresponding outer resonator for capacitively coupling the adjacent resonators with each other; and an additional conductor provided on the open-circuiting end surface for increasing an effective resonant length of each of the outer resonators, each additional conductor being arranged to be extended from the inner conductor of the corresponding outer resonator toward at least one edge of the open-circuiting end surface.

With the above arrangement, the effect of the increasing in the resonant length of each inner resonator due to the conductor pattern can be offset by that of its counterpart of each of of the outer resonators due to the extended conductor and the resonant frequencies of the resonators can be made substantially agree with each other. In this connection, the length of each of the resonators has to be made smaller than a specified value corresponding to the specified resonant frequency so that the specified resonant frequency can be achieved when it is extended by each conductor pattern or extended conductor.

According to another aspect of the invention, there is provided a dielectric filter comprising:

a dielectric ceramic block;

three or more than three resonators each of which includes a through hole in the dielectric ceramic block and an inner conductor provided on a peripheral wall of the through hole;

an outer conductor covering a specific area of the outer peripheral surface of the dielectric ceramic block except one end surface of the dielectric ceramic block which forms an open-circuiting end surface on which one openings of the through holes are positioned, the other openings being positioned at the other end surface of the dielectric ceramic block which is a short-circuiting end surface;

an elevated inner region provided on the open-circuiting end surface of the dielectric ceramic block so that the elevated inner region contains therein the openings of the resonators and is made higher than the outer region formed along the outer periphery of the open-circuiting end surface;

a conductor pattern provided on the elevated inner region of the open-circuiting end surface for each inner resonator, each conductor pattern having one end connected to the inner conductor of the inner resonator and other end or free end extended toward an edge of the opening of the adjacently located resonator for defining an insulating gap between the adjacent resonators so as to capacitively couple them with each other; and an additional conductor is provided on the elevated inner region of the open-circuiting end surface for increasing an effective resonant length of each of the outrermost resonators, each additional conductor being arranged to be extended from the inner conductor of the corresponding outermost resonator toward at least one edge of the elevated inner region.

Conventionally, if a printing plate to be used for preparing each conductor pattern and extended conductor is not aligned correctly with the dielectric ceramic block, each conductor pattern and extended conductor to be formed can be displaced relative to the through holes of the resonators. This means that each conductor pattern and extended conductor may come into contact with the outer conductor for short-circuiting. However, according to the present invention, each conductor pattern and extended conductor may be formed by applying an electroconductive material over the substantially entire width of the elevated inner region and thus there can be avoided any adverse effect of such relative displacement of the through holes of the resonators and the conductor pattern and the extended conductors. In this way, it becomes possible to precisely define the areas for the conductor pattern and the extended conductors so that the problem of inadvertently connecting them to the outer conductor to give rise to short-circuiting is effectively avoided.

DETAILED DESCRIPTION OF THE PREFERRED EMBODIMENTS

The present invention will now be described with reference to the accompanying drawings that illustrate preferred embodiments of the present invention. The components that are common to all the embodiments are denoted respectively by the same reference symbols and will not be described duplicatively.

Figure 1:
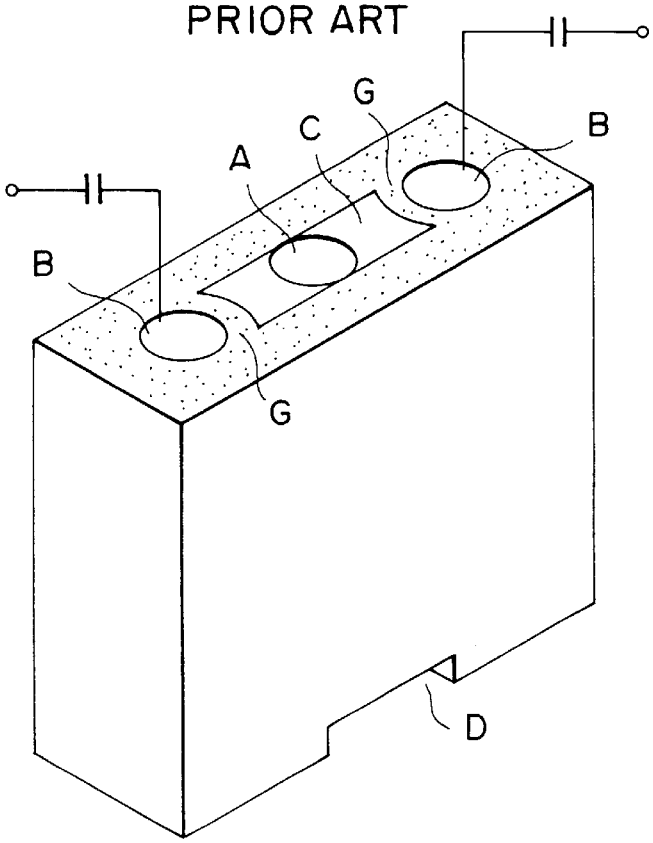
FIG. 1 PRIOR ART
FIG. 1 is a schematic perspective view showing a conventional dielectric filter of the type under consideration.
Figure 2:
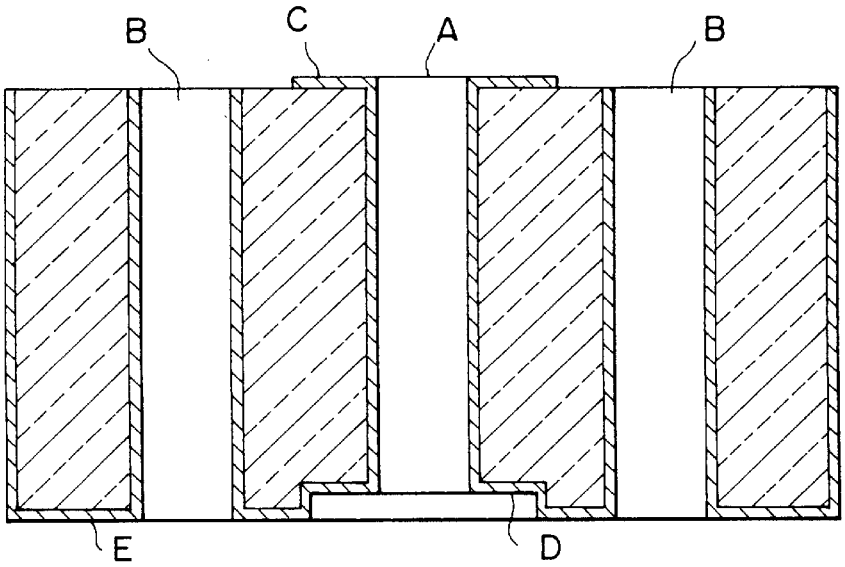
FIG. 2 PRIOR ART
FIG. 2 is a schematic longitudinal section showing the dielectric filter of FIG. 1.
Figure 3:
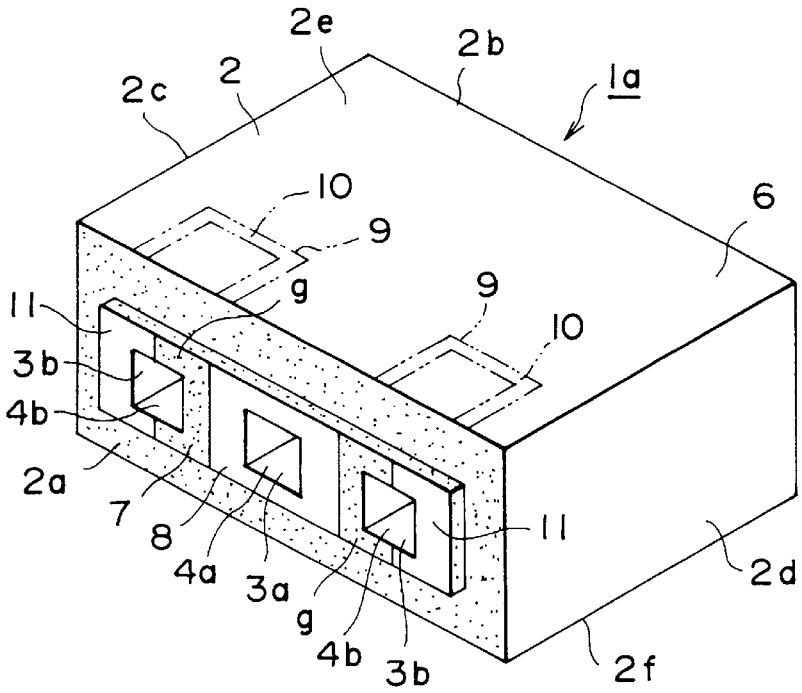
FIG. 3 is a schematic perspective view showing a embodiment according to the present invention.
Figure 4:
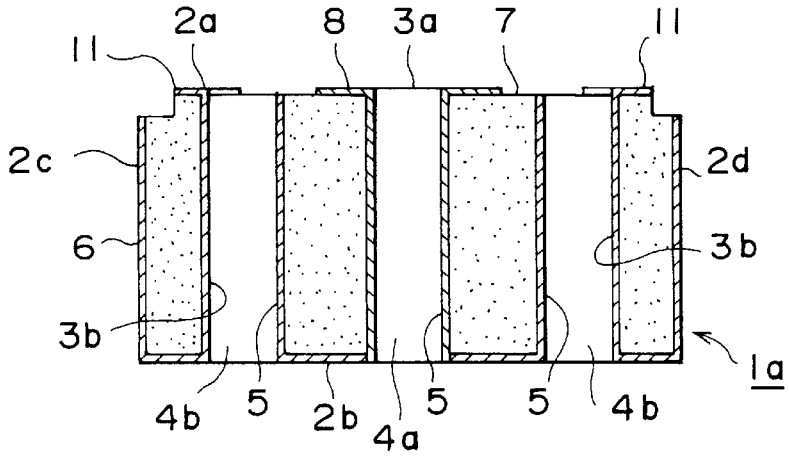
FIG. 4 is a schematic longitudinal section of the embodiment of FIG. 3, showing its principal components.

FIGS. 3 and 4 illustrate a dielectric filter of a three stage type according to a first embodiment of the present invention. The illustrated dielectric filter la comprises a dielectric ceramic block 2 on which three resonators 3*a* and 3*b* are provided. The dielectric ceramic block 2 is rectangularly parallelepipedic having six outer surfaces 2*a*, 2*b*, 2*c*, 2*d*, 2*e* and 2*f* and made of a titanium oxide type ceramic material. The resonators 3*a* and 3*b* are arranged in parallel with each other between the lateral side surfaces 2*c* and 2*d* of the dielectric ceramic block 2. The resonators 3*a* and 3*b* comprise through holes 4*a* and 4*b* and inner conductors 5 provided on the peripheral walls of the through holes 4*a* and 4*b*. Each of the through holes 4*a* and 4*b* has a rectangular cross section. The outer surfaces 2*b*, 2*c*, 2*d*, 2*e* and 2*f* of the dielectric ceramic block 2 are coated with an outer conductor 6 except the top surface 2*a* having the corresponding openings of the through holes 4*a* and 4*b*, which outer conductor 6 operates as a shield electrode. Each of the resonators 3*a* and 3*b* has a length substantially equal to $\lambda/4$ or a quarter of the specified resonant frequency for an intended dielectric filter.

An elevated inner region 7 is provided on the inner portion of the open-circuiting end surface 2*a* of the dielectric ceramic block 2 which contains therein the openings of the resonators 3*a* and 3*b*. The elevated inner region 7 is made higher than the outer region formed along the outer periphery of the open-circuiting end surface 2*a*. The elevated inner region 7 may be provided by cutting the outer periphery of the open-circuiting end surface 2*a* of the dielectric ceramic block 2. Alternatively, the elevated inner region 7 may be previously provided at the preparation of the dielectric ceramic block 2.

On the elevated inner region 7 of the open-circuiting end surface 2*a* is provided a conductor pattern 8 which is extended from the edge of the through hole 4*a* of the central resonator 3*a* toward the adjacent outer resonators 3*b*. That is, one end of the conductor pattern 8 is connected to the inner conductor 5 of the central resonator 3*a* and the other end or free end thereof is separated respectively from the corresponding edges of the outer resonators 3*b* by respective insulating gaps g so that the resonators 3*a* and 3*b* are capacitively coupled with each other by way of the gaps g.

A filtering circuit comprising the dielectric filter 1*a* can be connected directly to an external electric path with capacitors not shown being interposed respectively between the resonators 3*b* and the external electric path. Alternatively, the dielectric filter 1*a* may be mounted on a printed circuit board in such a manner that a pair of input/output pads 9 provided for the outer resonators 3*b* is electrically connected to an electric path on the printed circuit board. The input/output pads 9 may be arranged on the lateral side surface 2*f* of the dielectric ceramic block 2 at respective positions close to the open-circuiting end surface 2*a* thereof as shown by broken lines in FIG. 3. Each of the input/output pads 9 is separated from the outer conductor 6 by means of an insulating zone 10, and is capacitively coupled with the corresponding outer resonator 3*b*.

It should be noted here, however that the conductor pattern 8 thus formed increases the effective resonant length of the resonator 3*a* to lower its resonant frequency and make it disagree with those of the outer resonators 3*b*. Consequently, such a dielectric filter does not provide a satisfactory filtering effect.

According to the present invention, an additional conductor 11 is provided on the elevated inner region 7 of the open-circuiting end surface 2*a* for increasing an effective resonant length of each of the outer resonators 3*b*. Each additional conductor 11 is arranged to be extended from the inner conductor 5 of the corresponding outer resonator 3*b* toward the edge of the elevated inner region 7 of the open-circuiting end surface 2*a* on the the dielectric ceramic block 2.

With the above arrangement, the effect of the increase in the resonant length of the central resonator 3*a* due to the conductor pattern 8 can be offset by that of its counterparts of the outer resonators 3*b* due to the extended conductors 11 and the resonant frequencies of the resonators 3*a* and 3*b* can be made substantially agree with each other.

Note that the length of each of the resonators 3*a* and 3*b* have to be made smaller than the specified value corresponding to the specified resonant frequency so that the specified resonant frequency is achieved when it is extended by the conductor pattern 8 or the extended conductor 11.

In the illustrated embodiment, the conductor pattern 8 and extended conductors 11 can be accurately formed over the substantially entire width of the elevated inner region 7 by applying an electroconductive material because the conductor pattern 8 and extended conductors 11 are rectangular. This may be carried out by means of screen printing, using a mask for covering the peripheral zone of the open-circuiting end surface 2*a* of the dielectric ceramic block 2 and the gaps g. It is, therefore, possible to avoide the risk of inadvertently connecting the conductor pattern 8 and/or the extended conductors 11 to the outer conductor 6 through their relative displacement during preparation thereof. This arrangement is advantageous to produce an intended dielectric filter because the conductor pattern 8 and the extended conductors 11 may be easily formed without very high accuracy in the positioning thereof.

It should be understood that, while the resonators 3*a* and 3*b* of this embodiment have a square cross section, they may alternatively have a different cross sectional shape.

In this embodiment, again, the conductor pattern 8 may be formed as an extension of the inner conductor 5 of the central resonator 3*a* and is extended toward the outer resonators 3*b*. Also, the additional conductors 11 may be formed as extensions of the inner conductors 5 of the outer resonators 3*b*.

With this arrangement, the effect of the increase in the resonant length of the central resonator 3*a* due to the conductor pattern 8 can be offset by that of its counterparts of the outer resonators 3*b* due to the extended conductors 11 and thus the resonant frequencies of the resonators 3*a* and 3*b* can be made substantially agree with each other.

Figure 5:
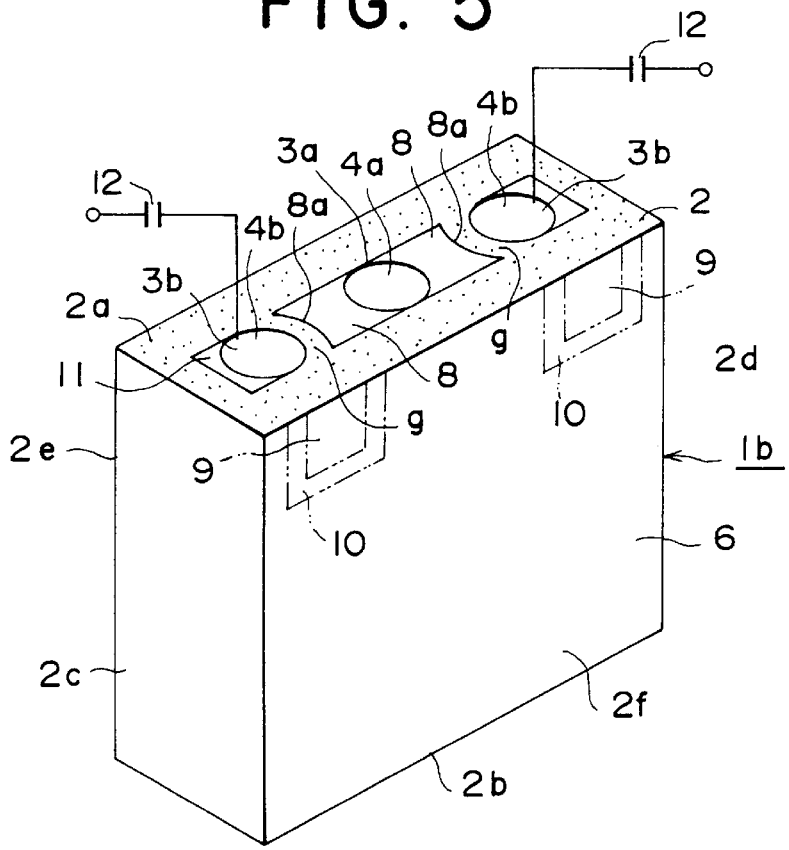
FIG. 5 is a schematic perspective view showing a dielectric filter according to another embodiment of the present invention.
Figure 6:
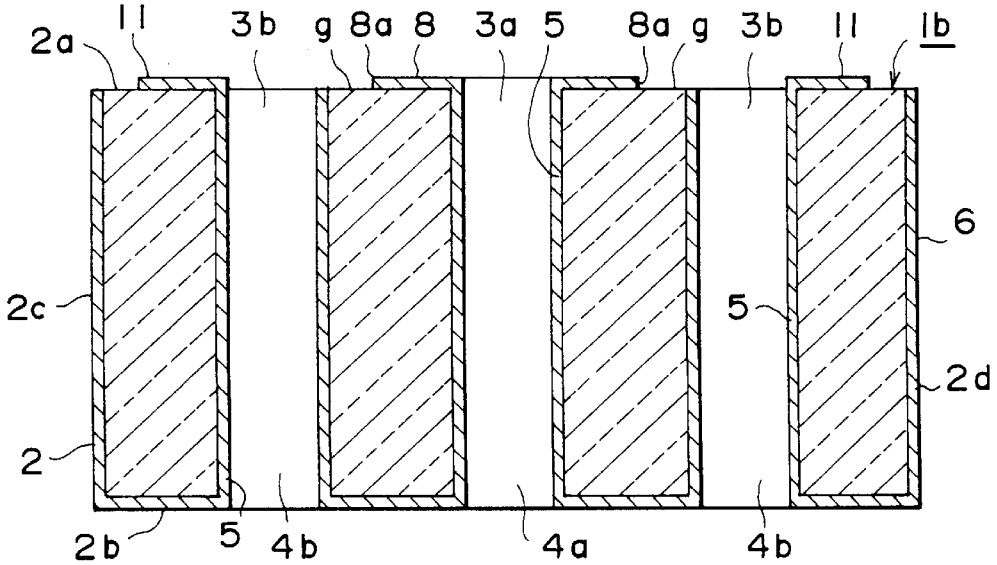
FIG. 6 is a schematic longitudinal section of the embodiment of FIG. 5, showing its principal components.

FIGS. 5 and 6 illustrate a dielectric filter of a three stage type according to another embodiment of the present invention. In the illustrated dielectric filter 1*b* a dielectric ceramic block 2 is provided with three resonators 3*a* and 3*b*. The dielectric ceramic block 2 is made of a titanium oxide type ceramic material. The resonators 3*a* and 3*b* are arranged in parallel with each other between the lateral side surfaces 2*c* and 2*d* of the dielectric ceramic block 2. The resonators 3*a* and 3*b* comprise through holes 4*a* and 4*b* each of which has a circular cross section and inner conductors 5 provided on the peripheral walls of the through holes 4*a* and 4*b*. The outer surfaces 2*b*, 2*c*, 2*d*, 2*e* and 2*f* of the dielectric ceramic block 2 are coated with an outer conductor 6 except the top surface 2*a*. The outer conductor 6 operates as a shield electrode as in the case of FIGS. 3 and 4. Each of the resonators 3*a* and 3*b* has a length substantially equal to $\lambda/4$ or a quarter of the specified resonant frequency for an intended dielectric filter.

On the open-circuiting end surface 2*a* of the dielectric ceramic block 2 are provided conductor patterns 8 each of which is extended from the edge of the through hole 4*a* of the central resonator 3*a* toward the adjacent outer resonators 3*b*. That is, one end of each conductor pattern 8 is connected to the inner conductor 5 of the central resonator 3*b* and the other end or free end thereof is separated respectively from the corresponding edges of the outer resonators 3*b* by respective insulating gaps g so that the resonators 3*a* and 3*b* are capacitively coupled with each other by way of the gaps g. Free end of each conductor pattern 8 is formed to have a circular arc 8*a* which is coaxial with the through hole 4*b* of the corresponding resonator 3*b* so that the gap g shows a unique width in the direction connecting the resonators 3*a* and 3*b*.

A filtering circuit comprising the dielectric filter 1*b* can be connected directly to an external electric path with capacitors 12 being interposed respectively between the resonators 3*b* and the external electric path. Alternatively, the dielectric filter 1*b* may be mounted on a printed circuit board in such a manner that a pair of input/output pads 9 provided for the outer resonators 3*b* is electrically connected to an electric path on the printed circuit board. The input/output pads 9 may be arranged on the lateral side surface 2*f* of the dielectric ceramic block 2 at respective positions close to the open-circuiting end surface 2*a* thereof as shown by broken lines in FIG. 5. Each of the input/output pads 9 is separated from the outer conductor 6 by means of an insulating zone 10, and is capacitively coupled with the corresponding outer resonator 3*b*.

In this embodiment, also, an additional conductor 11 is provided on the open-circuiting end surface 2*a* for increasing an effective resonant length of each of the outer resonators 3*b* so as to compensate any effect of the provision of the conductor pattern 8. Each additional conductor 11 is arranged to be extended from the inner conductor 5 of the corresponding outer resonator 3*b* toward the edge of the open-circuiting end surface 2*a* of the the dielectric ceramic block 2.

With the above arrangement, the effect of the increase in the resonant length of the central resonator 3*a* due to the conductor patterns 8 can be offset by that of its counterparts of the outer resonators 3*b* due to the extended conductors 11 and the resonant frequencies of the resonators 3*a* and 3*b* can be made substantially agree with each other.

It should be appreciated that the length of each of the resonators 3*a* and 3*b* have to be made smaller than the specified value corresponding to the specified resonant frequency so that the specified resonant frequency is achieved when it is extended by each conductor pattern 8 or the extended conductor 11.

Figure 7:
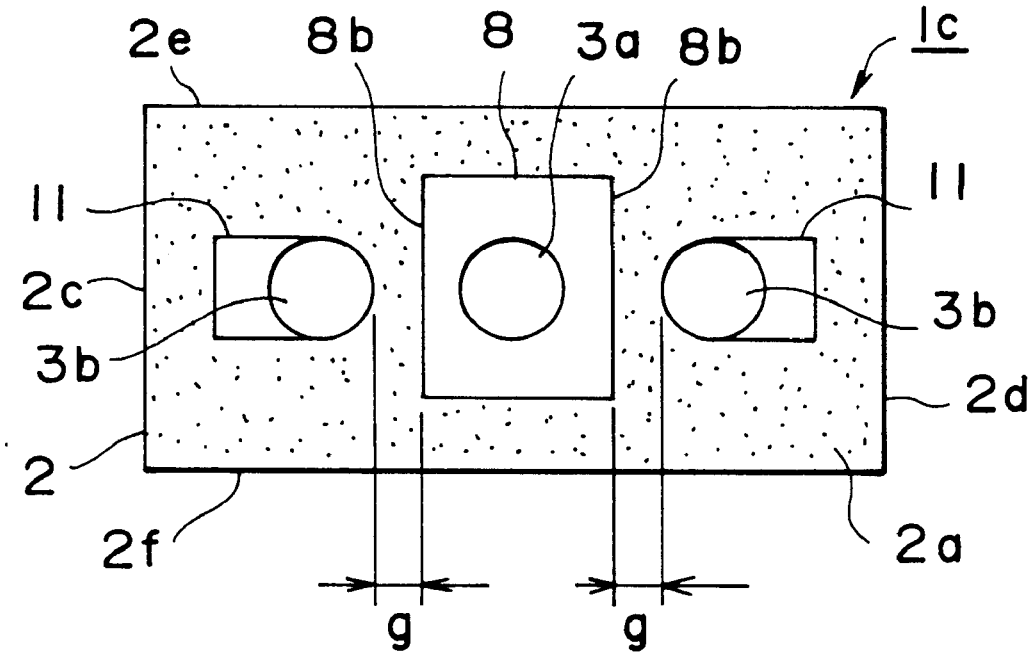
FIG. 7 is a schematic plane view showing a further embodiment of a dielectric filter according to the present invention.

FIG. 7 illustrates a dielectric filter 1*c* according to a further embodiment of the present invention, in which the conductor pattern 8 has a square or rectangular contour so that the free ends of the conductor pattern 8 which may face the respective edges of the resonators 3*b* form straight edges 8*b*.

As described above, in a dielectric filter according to the present invention, the open-circuiting end surface of the dielectric ceramic block is provided with the conductor pattern for each of the inner resonators and the additional conductor for each of the outermost resonators, the conductor patterns are intended to capacitively coupling the resonators with each other, and the additional conductors are intended to increase the effective resonant length of the outermost resonators. Therefore, the effect of the increase in the resonant length of each of the inner resonators due to the conductor pattern can be offset by that of its counterparts of the outermost resonators due to the extended conductors and thus the resonant frequencies of the resonators can be made substantially agree with each other to provide a dielectric filter that realizes a capacitive interstage coupling for coupling the resonators with each other and operates excellently. Thus, the present invention can provide a dielectric filter which does not require a recess on the bottom, or the short-circuiting side, of the dielectric ceramic block for regulating the resonant lengths of the resonators.

I claim:

1. A dielectric filter comprising:

a dielectric ceramic block;

at least three resonators each of which includes a through hole in the dielectric ceramic block and an inner conductor provided on a peripheral wall of the through hole, said through hole having openings at opposite ends thereof;

an outer conductor covering a specific area of the outer peripheral surface of the dielectric ceramic block except for one end surface of the dielectric ceramic block which forms an open-circuiting end surface on which one of the openings of each of the through holes is positioned, the other opening of each of the through holes being positioned at the other end surface of the dielectric ceramic block which is a short-circuiting end surface;

an elevated inner region provided on the open-circuiting end surface of the dielectric ceramic block so that the elevated inner region contains therein the openings of the resonators and is made higher than the outer region formed along the outer periphery of the open-circuiting end surface;

a conductor pattern provided on the elevated inner region of the open-circuiting end surface for each inner resonator, each conductor pattern having one end connected to the inner conductor of the inner resonator and the other end extended toward an edge of the opening of the adjacently located resonator for defining an insulating gap between the adjacent resonators so as to capacitively couple adjacent resonators with each other; and an additional conductor provided on the elevated inner region of the open-circuiting end surface for increasing an effective resonant length of each of the outermost resonators, each said additional conductor being arranged to be extended from the inner conductor of the corresponding outermost resonator toward at least one edge of the elevated inner region.

2. A dielectric filter as claimed in claim 1, wherein each said conductor pattern is arranged over the substantially entire width of the elevated inner region.

3. A dielectric filter as claimed in claim 1, wherein each of the through holes of the resonators has a rectangular cross section.

4. A dielectric filter as claimed in claim 3, wherein the other end of each conductor pattern is straight.

5. A dielectric filter as claimed in claim 1, wherein each of the through holes of the resonators has a circular cross section.

6. A dielectric filter as claimed in claim 5, wherein the other end of each conductor pattern is formed to have a circular arc which is coaxial with the through hole of the corresponding outer resonator.

* * * * *